US008499418B2

(12) United States Patent
Deveze

(10) Patent No.: US 8,499,418 B2
(45) Date of Patent: Aug. 6, 2013

(54) ANTI-TRAP DEVICE FOR A DOOR FRAME

(75) Inventor: Alain Deveze, Saint Priest en Jarez (FR)

(73) Assignee: DMP Systems, Saint Priest en Jarez (FR)

( * ) Notice: Subject to any disclaimer, the term of this patent is extended or adjusted under 35 U.S.C. 154(b) by 318 days.

(21) Appl. No.: 12/988,357

(22) PCT Filed: Apr. 17, 2009

(86) PCT No.: PCT/FR2009/000455

§ 371 (c)(1),
(2), (4) Date: Nov. 3, 2010

(87) PCT Pub. No.: WO2009/133313

PCT Pub. Date: Nov. 5, 2009

(65) Prior Publication Data

US 2011/0035901 A1 Feb. 17, 2011

(30) Foreign Application Priority Data

Apr. 18, 2008 (FR) ..... 08 02148

(51) Int. Cl.
*E05D 11/00* (2006.01)

(52) U.S. Cl.
USPC ..... 16/250; 16/264; 16/387; 49/383

(58) Field of Classification Search
USPC ..... 16/250, 251, 254, 260, 261, 264, 16/267, 270, 271, 272, 355, 356, 387, 389, 16/390, 391, 392, 82, 85, 86 R, 86 A, 86 B; 49/383, 384; 160/229.1
See application file for complete search history.

(56) References Cited

U.S. PATENT DOCUMENTS 2,331,340 A * 10/1943 Mosher ..... 49/383
2,557,716 A * 6/1951 Allee ..... 16/250

(Continued)

FOREIGN PATENT DOCUMENTS

DE 10023764 A1 11/2001
EP 0 237 789 A2 9/1987

(Continued)

OTHER PUBLICATIONS

International Search Report of PCT/FR2009/000455, Dated Mar. 12, 2010.

*Primary Examiner* — Jeffrey O Brien
(74) *Attorney, Agent, or Firm* — Laurence A. Greenberg; Werner H. Stemer; Ralph E. Locher

(57) ABSTRACT

In this device, the frame has, facing a rounded edge of the leaf B, an inclined surface, the distance of which from the frame A increases from the inside to the outside and which is connected to the internal surface of a covering strip, this strip being positioned parallel to the wall of the frame and at least in front of the rounded edge of the leaf B in order to prevent any access into the external gap between leaf B and frame A, while each of the hinge plates comprises, firstly, a male element fitting into a housing in the leaf, so as to be aligned therewith, and, secondly, a female element composed of: a cylindrical hinge body fitting into the male element so as to come into alignment with the rounded part; and a fastening base fitting into a housing recessed into the inclined surface of the frame so as to come into alignment with this surface.

12 Claims, 6 Drawing Sheets

U.S. PATENT DOCUMENTS

| | | | | |
|---|---|---|---|---|
| 2,597,174 | A * | 5/1952 | Patton et al. | 49/398 |
| 2,681,480 | A * | 6/1954 | Dixon, Sr. | 16/250 |
| 2,883,699 | A * | 4/1959 | Gross | 16/302 |
| 3,490,091 | A * | 1/1970 | Yombor | 16/85 |
| 4,878,267 | A * | 11/1989 | Roach et al. | 16/250 |
| 5,076,017 | A * | 12/1991 | Jacobs | 49/383 |
| 5,117,587 | A * | 6/1992 | Doan | 49/495.1 |
| 5,220,708 | A * | 6/1993 | Lucas et al. | 16/225 |
| 5,419,084 | A * | 5/1995 | Sankey et al. | 49/383 |
| 5,622,012 | A * | 4/1997 | Schijf | 160/232 |
| 7,555,816 | B2 * | 7/2009 | Walker | 16/355 |
| 2003/0200628 | A1 * | 10/2003 | Tatara | 16/355 |
| 2006/0101617 | A1 * | 5/2006 | Webb | 16/250 |
| 2006/0180282 | A1 * | 8/2006 | Requet | 160/229.1 |
| 2009/0288269 | A1 * | 11/2009 | Ross | 16/82 |
| 2010/0257788 | A1 * | 10/2010 | McRoskey | 49/383 |
| 2011/0121605 | A1 * | 5/2011 | Ruby et al. | 49/383 |

FOREIGN PATENT DOCUMENTS

| | | | |
|---|---|---|---|
| FR | 2623553 | A1 * | 5/1989 |
| FR | 2723136 | A1 | 2/1996 |
| FR | 2726317 | A1 | 5/1996 |
| FR | 2751370 | A1 | 1/1998 |
| WO | WO 8001090 | A1 * | 5/1980 |
| WO | 2007020424 | A1 | 2/2007 |

* cited by examiner

ANTI-TRAP DEVICE FOR A DOOR FRAME

BACKGROUND OF THE INVENTION

Field of the Invention

The invention relates to an anti-trap device for a door frame, that is to say for a door, a window or a French window, more commonly known as an "anti-finger-trap device".

When an opening leaf is brought into the open position, a space forms between the jamb and the rear edge face of the opening leaf and various elements including one or more fingers of an adult resting against the fixed frame or an inquisitive young child may enter this space. If the door is returned to the open position, the faces delimiting the space created move closer together and, like jaws, trap whatever is between them with a force that is all the higher because it is multiplied by the lever arm formed between the axis of articulation and the free edge of the opening leaf. While such trapping is painful to the fingers of an adult, it creates a great deal of trauma in the fingers of a child, which may suffer fractures with permanent after effects.

To remedy that, the prior art provides a number of solutions.

The solution most commonly employed to date is to fit, at least to the lower part of the opening leaf, on each side and between the opening leaf and the fixed frame, a cover which covers the exterior trap zone and prevents anything from entering it. Document FR2726317 describes one embodiment of this. This arrangement is effective, but esthetically highly unattractive.

In another solution, the opening leaf is articulated by pivots arranged top and bottom, as described in documents WO2007/0204024 and FR2723136. Document FR2751370 describes a double articulation with link rods that allow the opening leaf to pivot in such a way that it folds flat against the fixed frame. Thus, in the open position, the trapping jaws form an angle of 180° between them and no longer present any attraction to an inquisitive child.

In document DE10023764, which likewise relates to an articulation technique using pivots top and bottom, the opposing edge corners of the fixed frame and of the opening leaf respectively are one concave and the other convex and intermesh in such a way as to limit the radial clearance between them and, in the open position, to reduce the gap between the elements and thus prevent any possibility of fingers being inserted into this gap.

The disadvantage with these solutions is that they employ an articulation using pivots top and bottom, which are not suited to all styles of door frames and are difficult to remove.

In document EP0 237 789 which relates to an articulation for a wardrobe or cabinet door, the opening leaf is articulated to a fixed frame by at least two hinges the vertical axis of articulation of which is arranged transversely mid-way across the thickness of the fixed frame, said opening leaf having a rounded edge corner facing the fixed frame and each hinge comprising:

- on the one hand, an element that fits into a housing in the fillet of the opening leaf forming a continuation thereof,
- and, on the other hand, an element made up of:
  - an articulation body that fits into the element, which itself fits into a housing in the fillet of the opening leaf,
  - and a fixing mount that fits into a housing which opens out of the fixed frame facing the fillet of the opening leaf.

This cabinet door articulation is designed, by elastic notching, to immobilize the door in two positions, but provides no solution to the problem of children trapping their fingers between the opening leaf and the fixed frame because, as FIG. 9 of that document shows, the fillet of the opening leaf faces a planar face of the fixed frame with which it forms an open space 10" that is highly accessible to children's fingers.

BRIEF SUMMARY OF THE INVENTION

The object of the invention is to provide an anti-trap device for a door frame which, taking its inspiration from the last structure described, does not impair the esthetic look of the door frame, is reliable, regardless of the angle to which the opening leaf has been opened, is effective from both sides and, without complex operations, allows anybody to remove the opening leaf.

According to the invention, the fixed frame has, over its entire height and facing the fillet of the opening leaf, an inclined face of which the distance from the fixed frame increases in the direction from the inside to the outside and which joins onto the interior face of a cover strip, this strip being arranged parallel to the wall that bears the fixed frame and extending at least past the fillet of the opening leaf B to oppose any access to the exterior gap D between opening leaf and fixed frame, while each of the hinges comprises,

- on the one hand, a male element that fits into the fillet of the opening leaf forming a continuation thereof,
- and, on the other hand, a female element made up of:
  - a cylindrical articulation body that fits into the male element, and in the continuation of the fillet,
  - and a fixing mount that fits into a housing opening onto the inclined face of the fixed frame and in the continuation of this face.

Thanks to the rounded shape of the opening leaf, to the fact that it is pivoted near to the inclined face of the fixed frame and to the fact that the opening leaf is articulated about a vertical geometric axis arranged mid-way across the thickness and also thanks to the mount for each hinge, opening the opening leaf does not alter the size of the space between these elements, which means that there is no longer any exterior trap space.

Moreover, the fact that this space is covered by the strip protruding from the fixed frame prevents any foreign body from being introduced into this space.

On the other side of the articulation, that is to say on the same side as the faces which move closer together during the pivoting movement involved in opening the opening leaf, the rounded shape of the opening leaf slides over the body introduced into the space, heralding this movement and encouraging the removal of the object engaged in this space, before the jaws thus formed are in a position to trap. When they do bite or trap, the inclination of the face of the fixed frame generates a component of force which tends to drive out the body that is in the process of becoming trapped.

Depending on the embodiment, the inclined face facing the fillet of the opening leaf and the cover strip are formed in a section piece which is either added on and attached to the existing fixed frame of a door frame that is in the process of being converted, or constitutes the fixed frame of a new door frame.

This embodiment means that the anti-trap device can be used on existing or new door frames.

In one embodiment of the invention, the male element of each hinge consists of a couched U-shaped bracket each of the flanges of which bears a vertical hinge pin projecting toward the other flange, while in the female element of each hinge, the cylindrical articulation body has a C-shaped cross section which delimits an opening that can be closed off by a removable cover, this opening comprising a vertical groove to accept the hinge pins of the male element and, in its central part, a small bar that can be inserted between the ends of the hinge pins and constitutes a member for positioning the cover by collaboration with a horizontal slot made therein.

Depending on the application, the various components of the anti-trap device can be made of plastic or of metal, such as steel or aluminum.

Other features and advantages will become apparent from the description which follows, with reference to the attached schematic drawing which depicts one embodiment of the device according to the invention when applied to a door.

DESCRIPTION OF THE INVENTION

Figure 1:
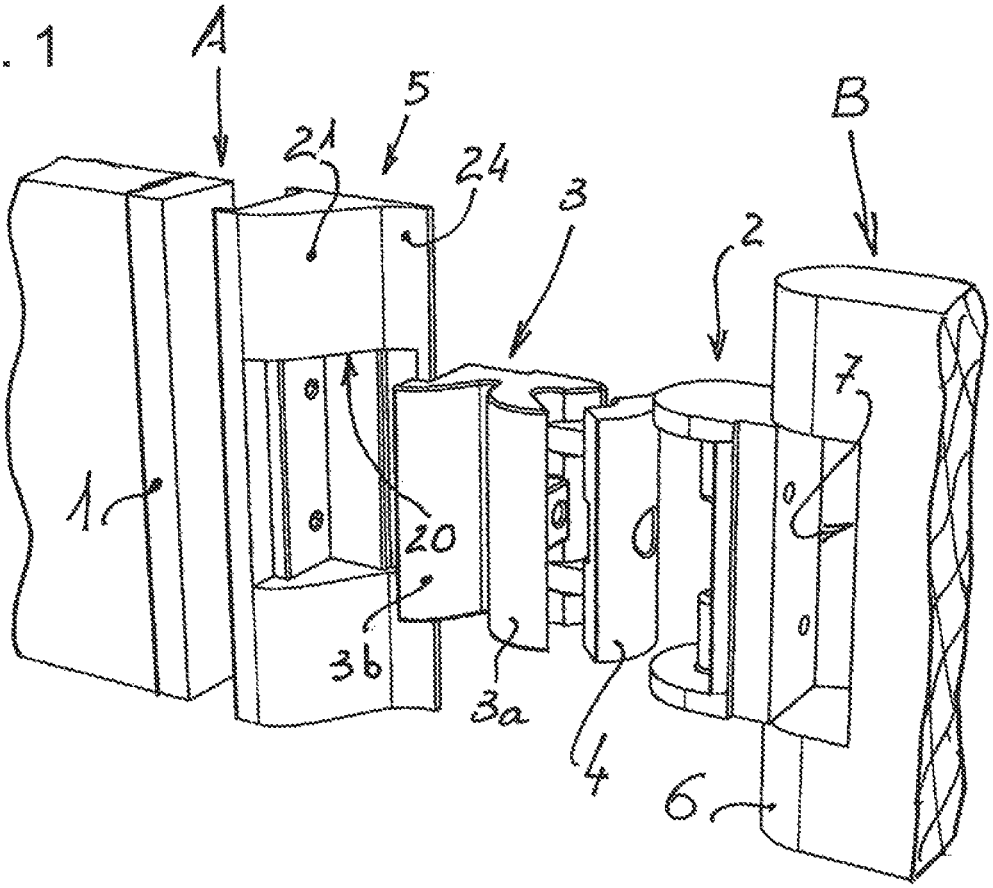
FIG. 1 is an exploded perspective view showing the various component parts of which the device is composed.

In this drawing, the fixed frame and the opening leaf of the door frame are referenced in general by the letters A and B while the components of the device are referenced by the following numerals: 2 and 3 for the respective male and female elements of the hinge, 4 for the cover that closes the female element 3, and 5 for the section piece which, in the embodiment depicted in FIG. 1, is added on against the fixed frame 1 of an existing door frame but which could also, as shown in FIGS. 8 to 15, itself constitute the fixed frame of the door frame.

In a known way, each opening leaf B is articulated to its fixed frame A by at least two and sometimes three unhingable hinges the axes of rotation of which are vertically aligned. In the device according to the invention, this geometric axis of articulation is arranged mid-way across the thickness of the door frame so that as the opening leaf moves, its edge corner does not protrude widening the trap zone D that forms on the outside upon opening. The components of the anti-trap device are produced by molding or casting and, depending on the embodiment, using plastics or metals such as steel, bronze or aluminum.

Figure 3:
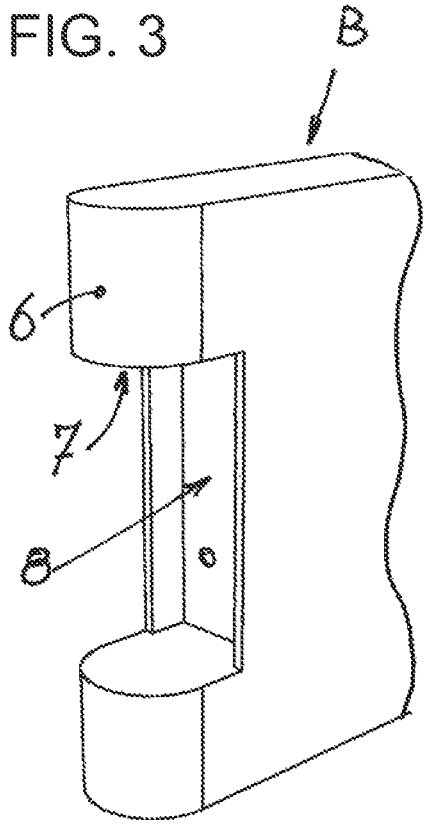
Figure 6:
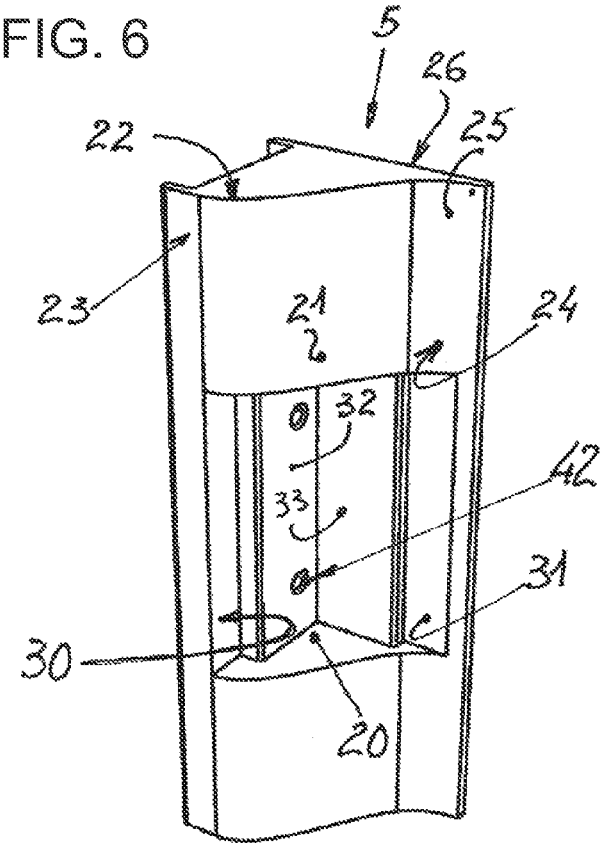
FIG. 6 is a partial perspective view of a section of the section piece that can be added to the fixed frame in the region where it has a housing to accept the female element of the hinge.

The device is mounted on an opening leaf B of which the edge or edge corner 6, which is intended to be articulated to the fixed frame A is rounded and has, locally, as shown in greater detail in FIG. 3, housings 7 each capable of accepting a hinge 2-3.

Figure 2:
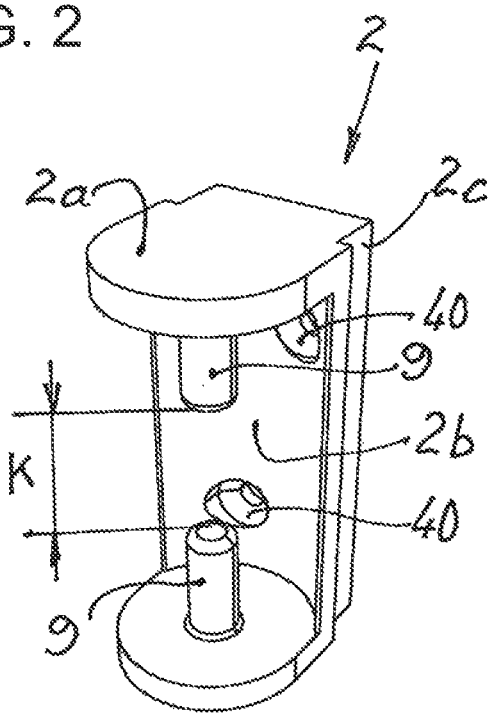
FIGS. 2 and 3 are perspective views of, respectively, the male element of the hinge and of the housing created for it in the rounded edge of the opening leaf.

As shown in greater detail in FIG. 2, the male element 2 of the hinge has the overall shape of a couched U-shaped bracket each of the flanges 2*a* of which has a rounded end with the same radius as the rounded feature of the opening leaf. Thus, when this element is fitted into one of the housings 7 in the opening leaf the rounded edges of its flanges lie in the continuation of the fillet of the opening leaf, that is to say neither setback therein nor protrude therefrom.

In order to achieve this precise positioning, the male element 2 has a dorsal tenon 2*c* which, projecting from its web 2*c*, fits into a mortise 8 created in the bottom of each housing 7.

Each of the flanges 2*a* carries a vertical hinge pin 9 which projects from its internal face and extends toward the other flange coaxial, with the hinge pin thereof. The opposing ends of the two hinge pins are separated by a gap K. Finally, FIG. 2 shows that the web 2*b* has, passing through it, two holes 40 for fixing screws used to attach the component to the opening leaf.

Figure 4:
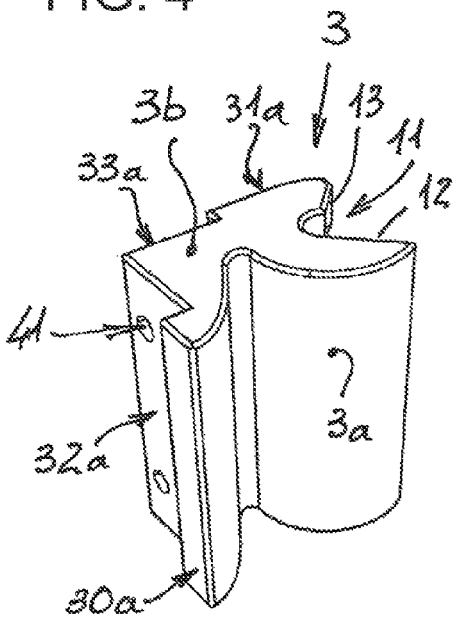
FIGS. 4 and 5 are perspective views of, from the rear and from the front respectively, the female element of the hinge.
Figure 5:
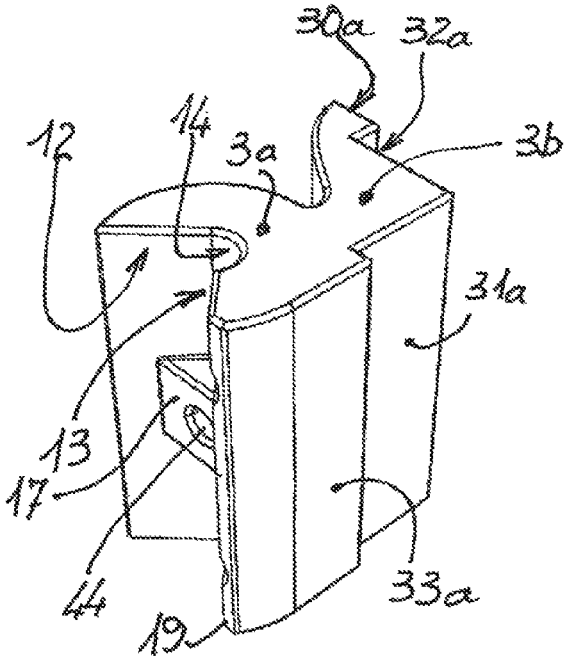

FIGS. 4 and 5 show that the female element 3 of the hinge, although monolithic, is made up of two parts, namely an articulation body 3*a* and a fixing mount 3*b*. The articulation body 3*a* is of cylindrical overall shape with a vertical axis and with a radius equal to that of the fillet 6 of the opening leaf, but has a C-shaped cross section. The opening 11 of the C is delimited by two radial faces 12 and 13 which converge toward a cylindrical and vertical groove 14 able to accommodate the hinge pins 9 of the male element 2. This opening is intended to accept a cover 4 in the shape of an annular segment, with the same external radius as that of the articulation body 3*a*. In its part that fits inside the body 3*a*, the cover has, passing vertically through it, a groove 14*a* which, with the groove 14 of the body 3*a*, forms the bearing in which the hinge pins 9 are mounted.

The cover 4 is positioned transversely via its radial faces 12*a* and 13*a* fitting against those 12 and 13 of the body and is positioned vertically by a transverse slot 16 arranged substantially mid-way up its height and fitting over a small bar 17 belonging to the articulation body 3*a*. This small bar has a vertical dimension which is smaller than the distance K between the two hinge pins 9, so that it can be inserted between them.

Figure 7:
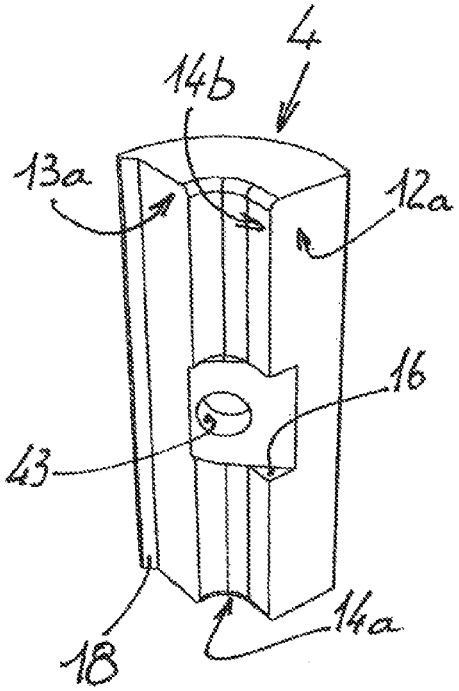
FIG. 7 is a perspective view of the cover that closes the female element.

In the embodiment depicted in FIG. 7, the cover 4 comprises a vertical tab 18 which is intended to cover a flat chamfer 19 formed after the face 13 of the body, the purpose of this being so that the assembly of the body with its cover forms a cylinder with no roughnesses or recesses that could catch on an object or a body pressed against this cylinder.

The rounded groove 14*a* of the cover connects to a clearance face 14*b* tangential to it and substantially parallel to the face 13*a*, the usefulness of which will be specified later.

The attachment mount 3*b* of each hinge is intended to fit into one of the housings 20 which are formed vertically in the section piece 5 that constitutes the fixed frame A of the door frame or is attached thereto.

In each of these two applications, the face 21 which is intended to face the rounded edge 6 of the opening leaf is inclined by around 45° extending away from the fixed frame in the direction from the inside to the outside. This inclined face joins, on the interior side, by a convex fillet 22 to the interior lateral face 23 and, on the other side, is joined by a convex fillet 24 to a cover strip 25 arranged in the continuation of the external lateral face 26 of the wall.

Each of the housings 20 has an annular shape and is defined by two vertical walls these respectively being the bottom wall 30 and the side wall 31. Projecting from each of these walls is a vertically directed rib 32 and 33 respectively. The stepped profile of the housing 20 corresponds to that of the base of the mount 3*b* of the hinge that is to be fitted into it. FIG. 4 shows the faces 30*a* to 33*a* of the mount 3*b* which, by coming into contact with the faces 30 to 33 of the housing, position this mount and the female element 3*b* of the hinge with respect to the fixed frame.

The male element 2 of each hinge is attached to the opening leaf B by horizontal screws passing through the holes 40 made in the web 2*c*, while the female element 3 is attached to the section piece 5 by horizontal screws passing through plain holes 41 in the element and screwed into tapped holes 42 in this section piece. The cover 4 is attached to the female element 3 by a horizontal screw 45 passing through it via a plain hole 43 and screwed into a tapped hole 44 in the female element 3.

Figure 8:
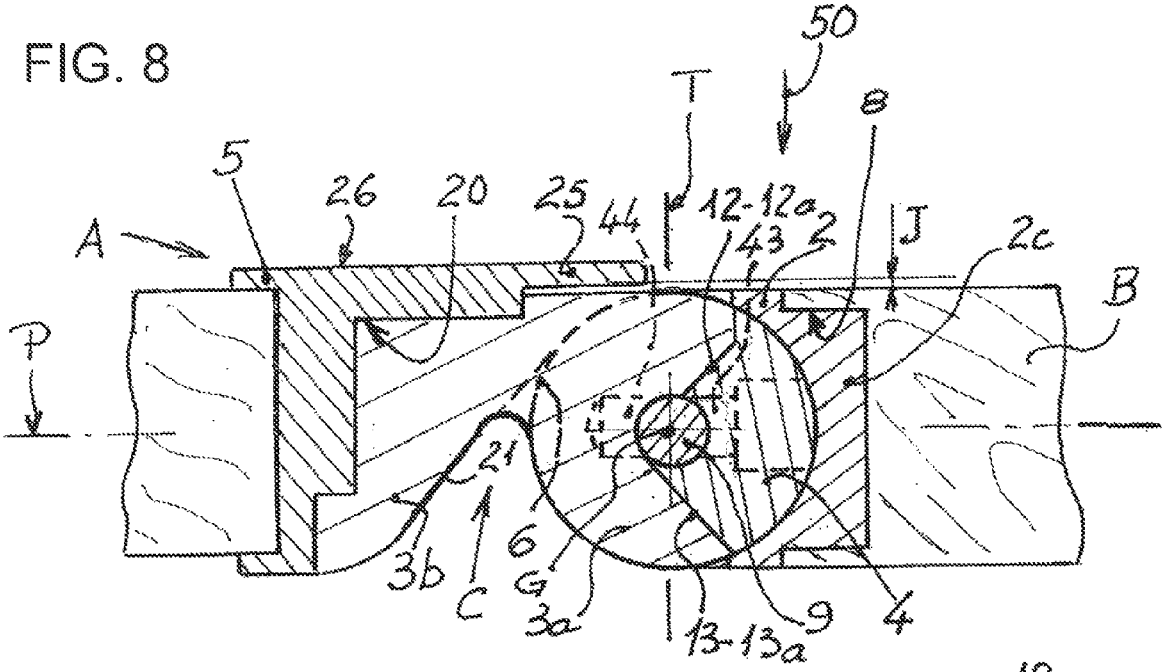
FIGS. 8 and 9 are large-scale partial views showing one hinge in cross section when the opening leaf is in the closed position and in the position for removing the cover, respectively.

As FIG. 8 shows, when the hinge is assembled and fixed into the housing 20 of the section piece or of the fixed frame, its mount 3*b*, which has the same transverse profile as that of the section piece 5 or of the end face of the fixed frame, does not form any projection or recess that could catch on a body introduced into the interior trap space C during opening or closing movements of the opening leaf B. During opening, which brings the opening leaf B from the position depicted in FIG. 8 to that of FIG. 9, the reduction in the width of the space C needed in order to be able to open the door through more than 90°, and for example to 120°, does not give rise to any trapping. Specifically, if a body becomes trapped between the interior face B1 of the opening leaf and the inclined face 21 of the fixed frame, the inclination of the face 21 generates a component of the clamping force which tends to drive this body outward and in any event encourage its extraction from the zone.

This same figure shows that the geometric axis of articulation G of the hinge is mid-way across the thickness of the fixed frame B, that is to say is in the vertical mid-plane P of this fixed frame A and of the opening leaf B. It also shows that the various elements of the articulation and of each of the hinges are in the continuation of one another, with no protrusion or recess and are dimensioned so that the cover strip 25, which extends toward the opening leaf almost as far as the transverse plane T, passing through the geometric axis of articulation, is spaced away from the fillet 6 of the opening leaf B by a value J of between 1 and 2 millimeters.

Thanks to this arrangement, the exterior trap zone D is non existent and is protected over the entire height of the door frame by the strip 24, this being true for all the positions that the opening leaf can occupy as shown by FIGS. 10 to 15. In this exterior zone D, the small value of the clearance J prevents any introduction of foreign bodies and therefore of children's fingers. Further, the smooth nature of the edge of the opening leaf and of the visible part of the hinge prevents any catching on foreign bodies outside of the strip 25 and prevents the foreign body from being retained during the closing movement of the opening leaf, thus eliminating any risk of trapping.

Figure 9:
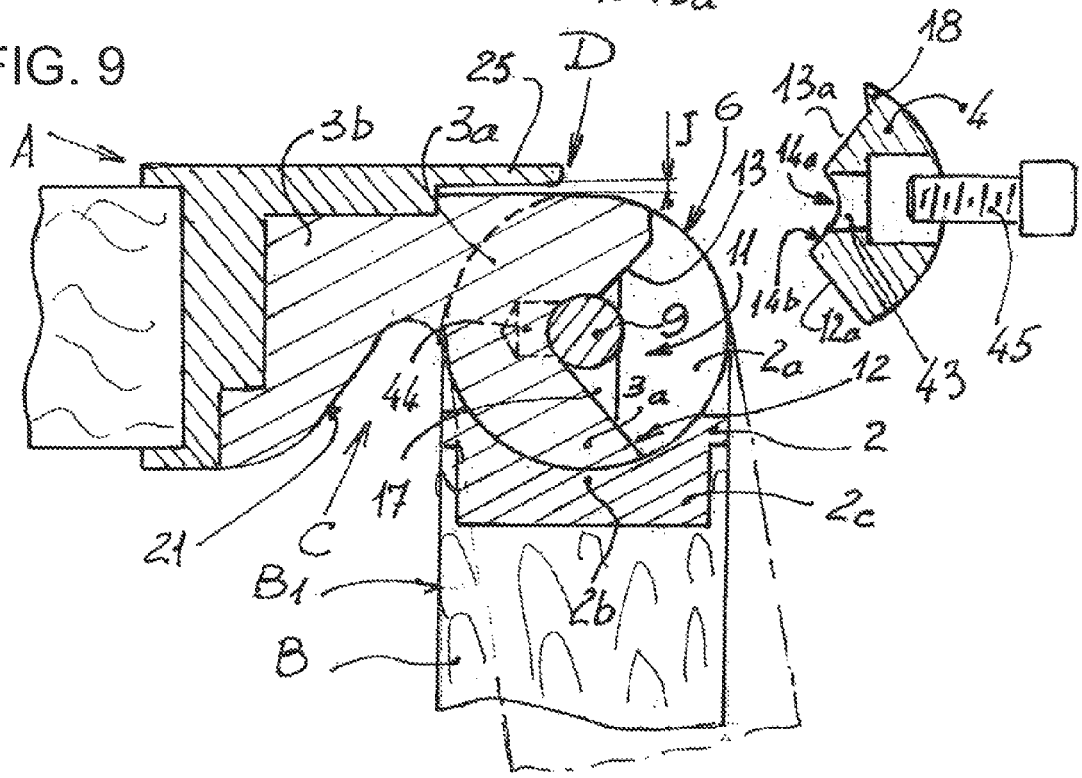
Figure 10:
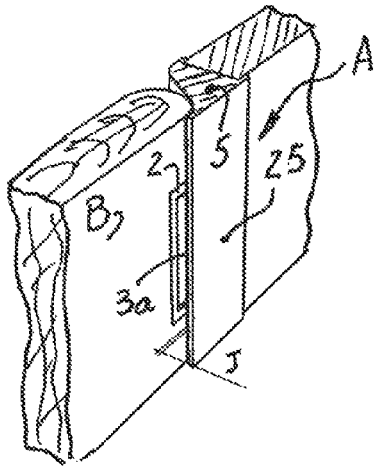
FIGS. 10 to 12 and 13 to 15 are partial perspective views of a fragment of the door frame these respectively being views from the outside of a construction in the case of FIGS. 10 to 12 and from the inside of this construction in the case of FIGS. 13 to 15 and, within each series, when the opening leaf is, in turn, aligned with the fixed frame, in the process of being opened, and wide open.
Figure 11:
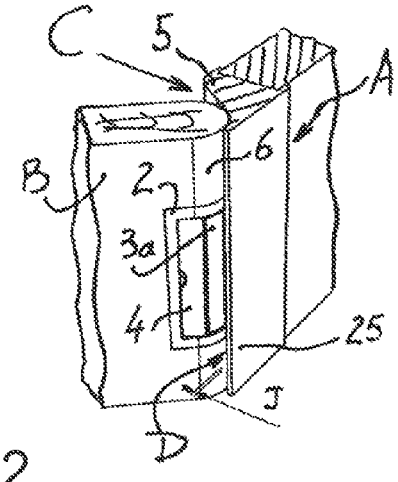
Figure 12:
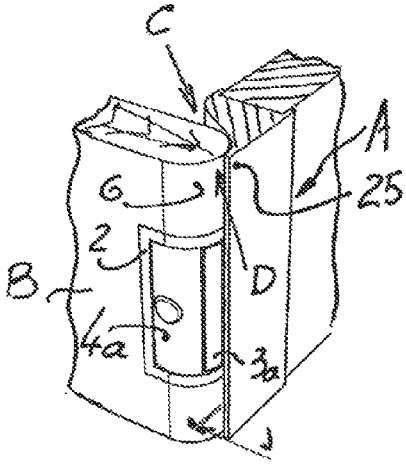
Figure 13:
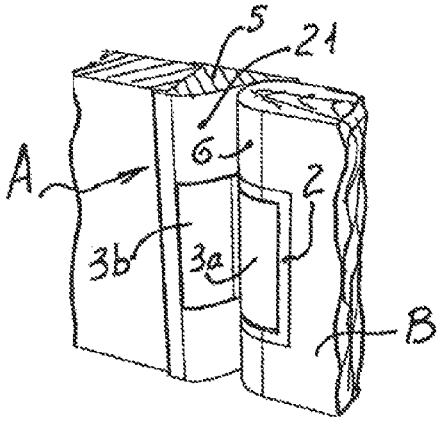
Figure 14:
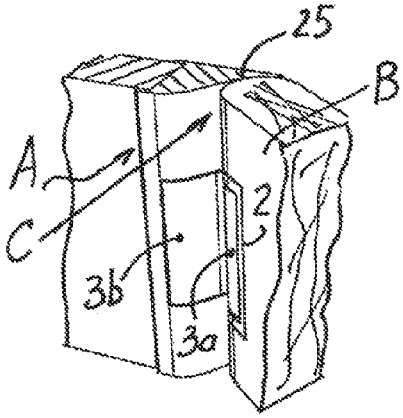
Figure 15:
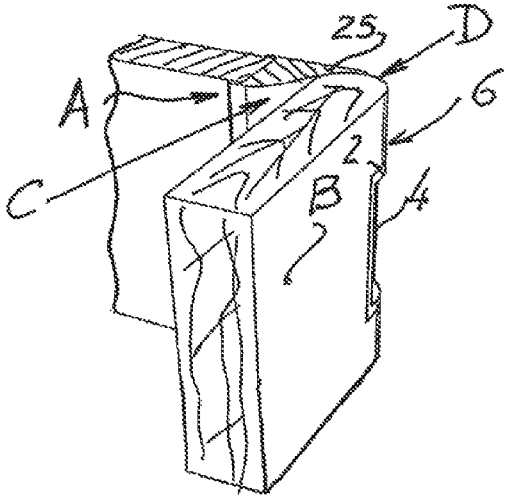
Figure 16:
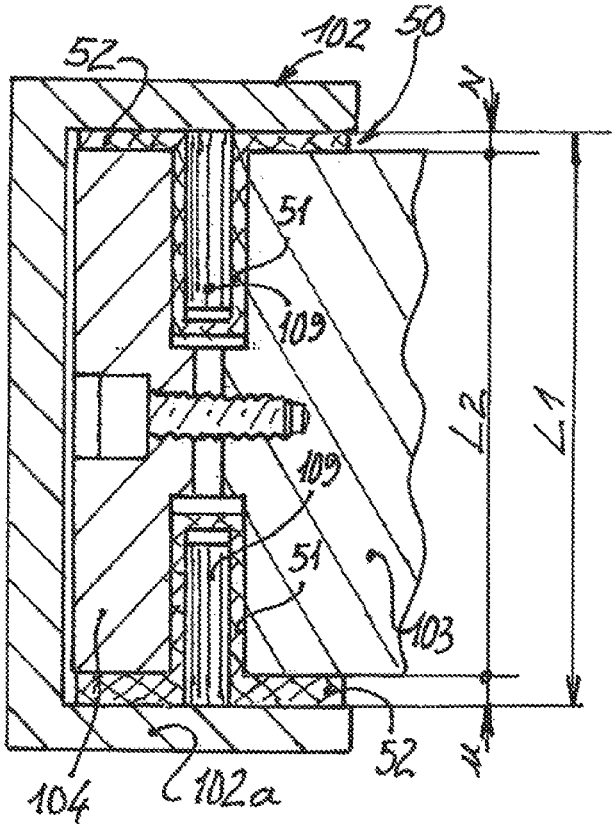
FIG. 16 is a sectional part view showing an alternative form of the means of articulation.
Figure 17:
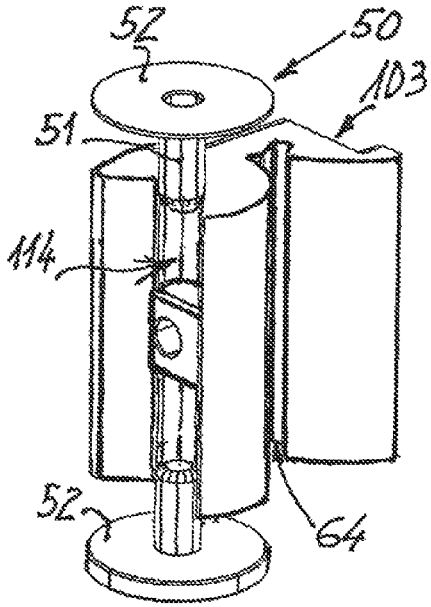
FIG. 17 is a partial perspective view and on a smaller scale of a female hinge element with one embodiment of its thickness washers.

FIG. 9 depicts the opening leaf B when it is opened through 90° to uncover the opening 11 formed in the female element 3 and allow the cover 4 to be extracted with a view to unhinging the opening leaf B.

It will be noted that the removal of the cover 4 is made easier by its clearance face 14*b* which does not catch on the hinge pins and allows it to be moved radially out of the opening 11, even though this opening is not completely uncovered by the web 2*b* of the element 2.

To facilitate unhinging once the cover has been extracted, the door has to be returned to a smaller angle of opening, of the order of 80° as shown in chain line, allowing the hinge pins 9 to slide against the face 12 of the opening created in the female element 3.

To re-fit the opening leaf, the reverse procedure has to be followed. It should be noted here that the faces 12 and 13 of each of the female elements 3 of the hinges facilitate the engagement of the hinge pins in the bottom of the openings 11, which means that there is no need to check their alignment with the elements that accommodate them, as was the case with traditional opening leaves comprising hinge pins. This means that refitting becomes vastly easier.

Finally, and according to one feature of the invention, on the one hand, the mid-plane of the opening 11 formed in the articulation body 3*a* for the cover 4 and, on the other hand, the geometric axis of the holes 43 and 44 for the fixing screws 45 that connect the cover to the body 3*a*, are substantially in the vertical mid-plane P of the articulation.

Thanks to this special arrangement, in the event of malicious intent to unhinge the door when it is closed by kicking the door from the outside or by applying forces to it in the direction of the arrow 50 in FIG. 8, the connection assemblies that are the tappings 43 and the screws 45 of the hinges are subjected to shear forces which they can resist several times better than they can work in tension, were they transverse.

Moreover, when the faces 12 and 13 delimit an angle of the order of 90° between them, the transverse forces applied to the faces 12 and 13 have components parallel to the mid-plane P which reduce the value of the transverse forces and limit the consequences of break-in attempts.

It is clear from the foregoing description that the device according to the invention fully performs the function of preventing an adult or a child from trapping his or her fingers, does not wreck the esthetic look of the door frame and at the same time offers resistance to vandalism that is as effective as that offered by opening leaves with hinge pins.

In the embodiments which follow, elements that have the same shapes and perform the same functions retain their reference numerals, those which have been modified are referenced by adding 100 and those which are new are referenced from 50 upward.

The embodiment shown in FIGS. 16 to 18*c* differs from the preceding embodiments through the addition to each hinge pin 109 of an articulation piece 50 made up of a bushing 51 inserted between one of the hinge pins 109 and its bore 114, and of a circular flange 52 inserted between one flange 102*a* of the male element 102 and the opposing face of the female element 103 and of the cover 104. The articulation piece 50 is made of a plastic with a high coefficient of slip, such as polytetrafluoroethylene.

This arrangement considerably reduces the friction forces during movements of the door, but also affords a possibility of adjusting the vertical functional clearance, for example in order to compensate for wear over time.

To this end, in each hinge, the articulation pieces 50 associated with the hinge pins 109 of one and the same male element 102 are paired in series Q1, Q2, Q3 . . . Qn, and in such a way that the thickness v of one of the circular flanges of the pair is the complement of the thickness u of the other washer, so that the sum S=v+u is equal, give or take a functional clearance, to the difference L1–L2 between the gap L1 between the flanges 102*a* of the male element and the thickness L2 of the female element 103 and of the cover 104.

Figure 18C:
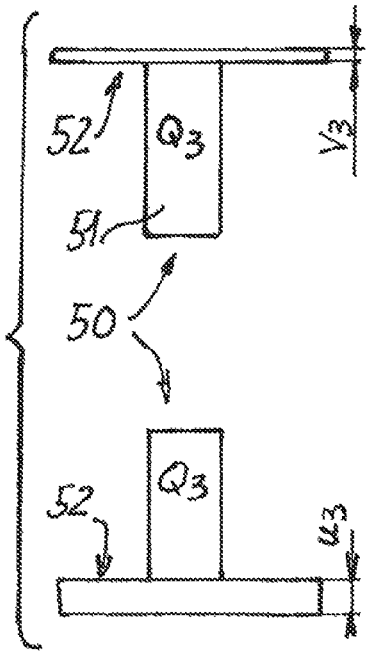
FIGS. 18*a* to 18*c* are side elevations showing a series of pairs of thickness washers.
Figure 18B:
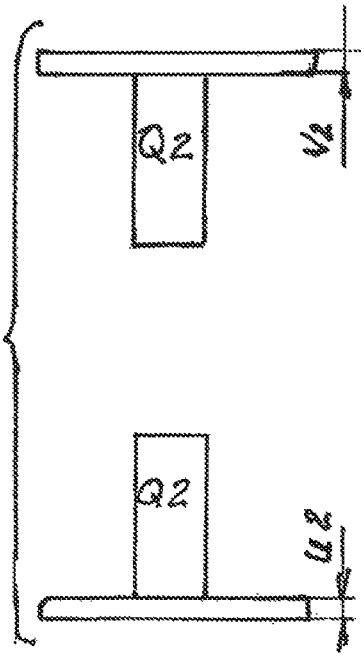
Figure 18A:
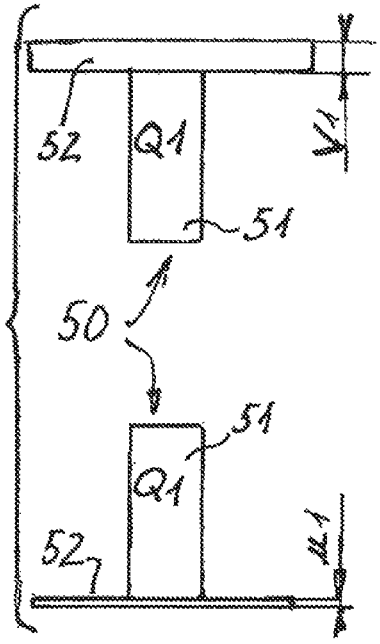

The paired pieces are chosen from a series of pairs which, as FIGS. 18*a* to 18*c* for series Q1 to Q3 show, differ in terms of the values of the thickness of the circular flanges within each pair, for example v1 and u1, v2 and u2, v3 and u3, etc.

In practice, the value of S is of the order of 5 millimeters and the increment of variation is of the order of 1 millimeter starting from a starting thickness of 0.5 to 1 millimeter. The components of each pair are reversible and are identified either by color or by a visible code, so that there can be no intermixing of components between the various series.

With this arrangement, if following repeated use the opening leaf B drops with respect to the fixed frame A, the height of the articulation afforded by the hinges can easily be adjusted once the door has been removed. All that is required is for the articulation pieces 50 of a series Q1 to be replaced by a series of pieces Q2 or Q3 which, for the lower circular flange, have a thickness u2 or u3 that is greater than the initial thickness u1 and, correspondingly and to compensate, a smaller thickness v2 or v3 of the upper circular flange, so that the value L1 remains constant.

Figure 19:
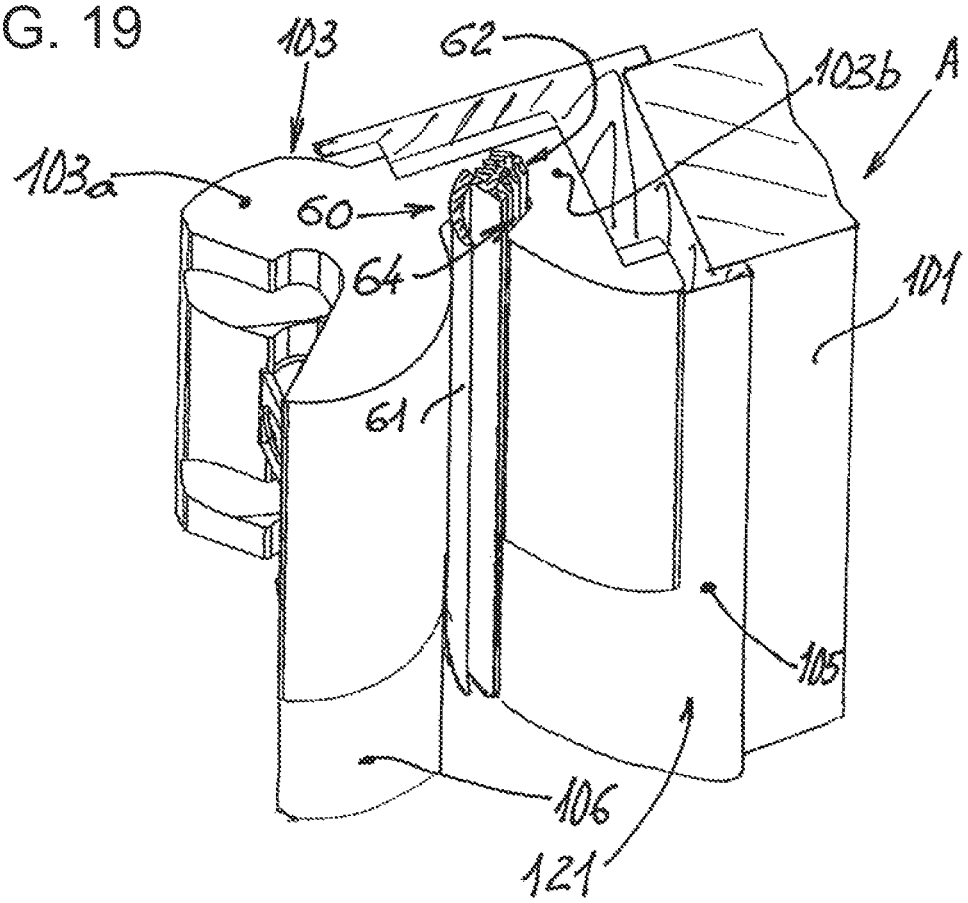
FIG. 19 is a partial perspective view of one embodiment of the female component comprising a slot for an additional anti-trap seal.
Figure 20:
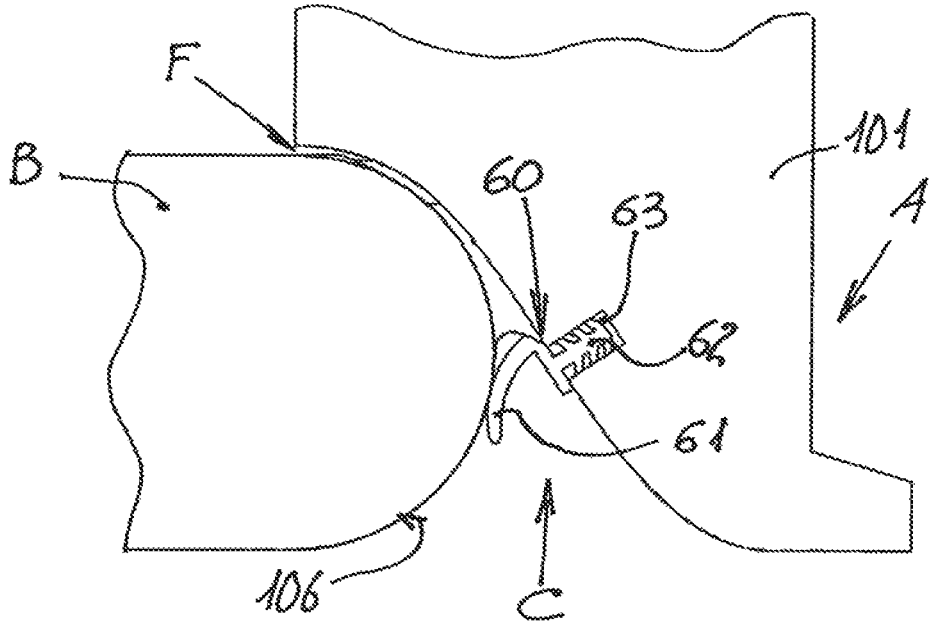
FIG. 20 is a partial plan view, from above, of a door the fixed frame of which is fitted with the anti-trap seal.

In the embodiment of FIGS. 19 and 20, over the entire height of the opening leaf B, the interior trap space C is closed off by a seal 60 the active part 61 of which presses elastically against the fillet 106 of the opening leaf B and against the rounded faces 103*a* of the female elements 103. This active part is depicted as being a narrow strip but could adopt any other form, provided that it is firmly pressed elastically against the rounded faces thus opposing any introduction of bodies or fingers into the space C, as shown in FIG. 20.

The seal 60 is fitted with a heel 62 via which it is set into a vertical slot 63 opening onto the inclined face 121 of the section piece 105 and into a slot 64 which, opening into the space C from the fixing mount 103, is aligned with the first slot 63.

By closing off the functional space F between the opening leaf B and the fixed frame C, the seal 60 thus contributes to the reduction of sound and noise transmission.

The invention claimed is:

1. An anti-trap of a door frame, in which an opening leaf is articulated to a fixed frame, the anti-trap device comprising:

at least two hinges having a vertical axis of articulation disposed transversely mid-way across a thickness of the fixed frame, the opening leaf having a rounded edge corner facing the fixed frame, the fixed frame having an inclined face over an entire height thereof and said inclined face facing the rounded edge corner of the opening leaf, said inclined face defining a distance from the fixed frame which increases in the direction from an inside to an outside;

a cover strip having an interior face, said inclined face joining onto said interior face of said cover strip, said strip being disposed parallel to a wall bearing the fixed frame and extending at least past the rounded edge corner of the opening leaf opposing any access to an exterior gap between the opening leaf and the fixed frame, each hinge including, a male element fitting into a housing in said rounded edge corner of the opening leaf and defining a continuation of said rounded edge corner;

a female element having a cylindrical articulation body fitting into said male element and defining a continuation of said rounded edge corner, and a fixing mount fitting into a housing opening in said inclined face of the fixed frame, said fixing mount defining a continuation of said inclined face.

2. The anti-trap device according to claim 1, wherein said inclined face and said cover strip are formed in the fixed frame.

3. The anti-trap device according to claim 1, wherein said inclined face said cover strip are formed in a section piece which is attached to the fixed frame.

4. The anti-trap device according to claim 1, wherein said male element of each hinge has a U-shaped bracket with flanges, each of said flanges bears a vertical hinge pin projecting toward one another.

5. The anti-trap device according to claim 4, wherein said male element of each hinge has a web, said web of each hinge has a dorsal tenon configured to interact with a mortise formed in a bottom of said housing that accepts said male element, to position edges of said male element in alignment with said rounded edge corner of the opening leaf.

6. The anti-trap device according to claim 4 wherein said cylindrical articulation body has a central part and a C-shaped cross section which delimits an opening that can be closed off by a removable cover, said opening has a vertical groove to accept said hinge pins of said male element and, in said central part, a small bar is insertable between ends of the hinge pins and defines a member for positioning said removable cover by collaboration with a horizontal slot made in said removable cover.

7. The anti-trap device according to claim 6, wherein said removable cover includes a vertical groove which, on one side thereof connects to a clearance face which is tangential to said vertical groove and substantially parallel to a lateral face which delimits said cover on another side.

8. The anti-trap device according to claim 1, wherein said fixing mount of said female element, includes a profile in a back thereof, said fixing mount has fixing faces, said fixing faces complement housing faces formed in a bottom of said housing opening in said inclined face that accepts said female element, to provide transverse positioning of said female element.

9. The anti-trap device according to claim 6, further comprising body faces in the cylindrical articulation body delimiting said opening, said body faces being positioned, with respect to said fixing mount, for allowing said removable cover to be removed once an angle of opening of 90° has been exceeded and that the opening leaf can be unhinged for an angle of opening of 80° .

10. The anti-trap device according to claim 6, wherein a mid-plane of said opening and a geometric axis of holes for fixing screws that connect said removable cover to said cylindrical articulation body, are substantially in a vertical mid-plane of articulation of the anti-trap device.

11. The anti-trap device according to claim 5, further comprising a pair of articulation pieces made of a plastic with a very low coefficient of friction associated with said hinge pins of each hinge, said articulation pieces each being defined by a bushing fitting over a respective said hinge pin and of a circular flange, thicknesses of the circular flanges of said pair of articulation pieces being defined such that a sum of said thicknesses is equal to a difference of a distance between said flanges and a thickness of the female element.

12. The anti-trap device according to claim 1, wherein, over an entire height of the opening leaf, an interior trap space is closed off by a seal, said seal having an active part which presses elastically against said rounded edge corners of the opening leaf and against rounded faces of said female elements.

* * * * *